US006244185B1

(12) United States Patent
Yip

(10) Patent No.: US 6,244,185 B1
(45) Date of Patent: Jun. 12, 2001

(54) SKYROCKET

(75) Inventor: Dennis K. Yip, Hong Kong (HK)

(73) Assignee: Po Sing Fireworks Ltd., Hong Kong (HK)

( * ) Notice: Subject to any disclaimer, the term of this patent is extended or adjusted under 35 U.S.C. 154(b) by 0 days.

(21) Appl. No.: 09/497,358

(22) Filed: Feb. 3, 2000

(51) Int. Cl.[7] ..... F42B 4/14

(52) U.S. Cl. ..... 102/352; 102/351; 102/360; 102/361; 102/342; 102/345; 102/275.3; 102/275.7; 102/347; 102/349

(58) Field of Search ..... 102/351, 352, 102/360, 361, 342, 345, 275.3, 275.7, 347, 349

(56) References Cited

U.S. PATENT DOCUMENTS 60,491 * 12/1866 Detwiller .
925,567 * 6/1909 Due .
950,591 * 3/1910 Braquier .
1,299,217 * 4/1919 Pain .
1,326,493 * 12/1919 Gowdy .
1,326,494 * 12/1919 Gowdy .
1,376,797 * 3/1921 Case .
1,666,598 * 4/1928 Hitt .
1,761,820 * 6/1930 Fabrizio .
1,922,081 * 8/1933 Driggs, Jr. .
2,086,618 * 7/1937 Hitt .
2,535,309 * 12/1950 Mari .
5,423,264 * 6/1995 Siegler et al. .

* cited by examiner

*Primary Examiner*—Michael J. Carone
*Assistant Examiner*—Glenda L. Sánchez
(74) *Attorney, Agent, or Firm*—Hovey, Williams, Timmons & Collins

(57) ABSTRACT

A skyrocket is provided which provides a first fireworks effect prior to launch as well as a second effect after launching. The skyrocket includes a body which houses or is coupled to a rocket motor, a first effect and a second effect. A transparent or translucent nose cone is placed on the top end of the body which provides both the ability to view one of the effects placed therein but also maintains the aerodynamic properties of the skyrocket. The first effect may be a strobing effecting which during burning provides a pulsating intensity of light visible through the nose cone prior to lift-off of the skyrocket, and the second effect may be a bursting charge which explodes after the rocket is in flight. An ignition fuse leads to the first effect and a second fuse leads to the rocket motor so that by lighting the first fuse, no further fuses need be lit and a delay is provided before the rocket motor ignites.

23 Claims, 2 Drawing Sheets

Fig. 3
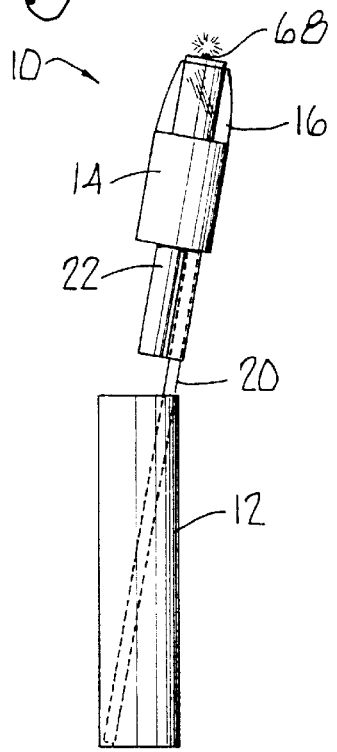
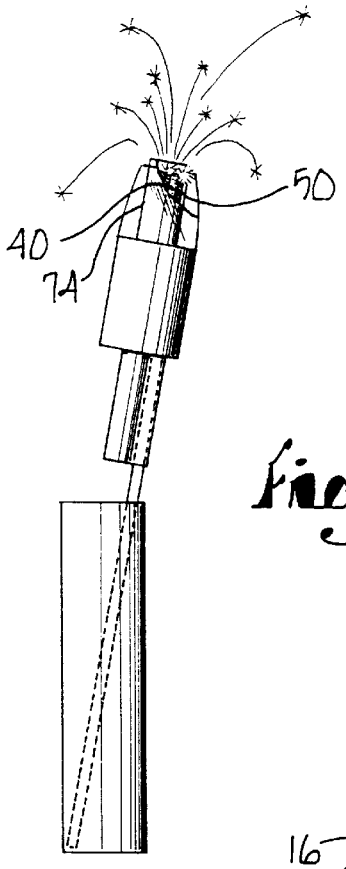
Fig. 4
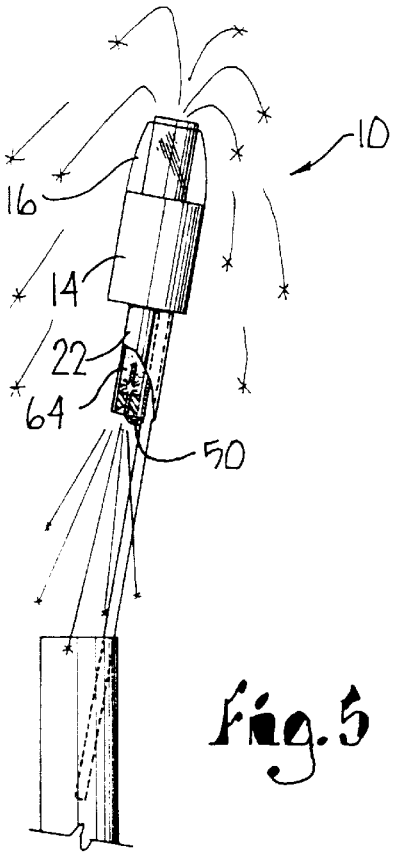
Fig. 5
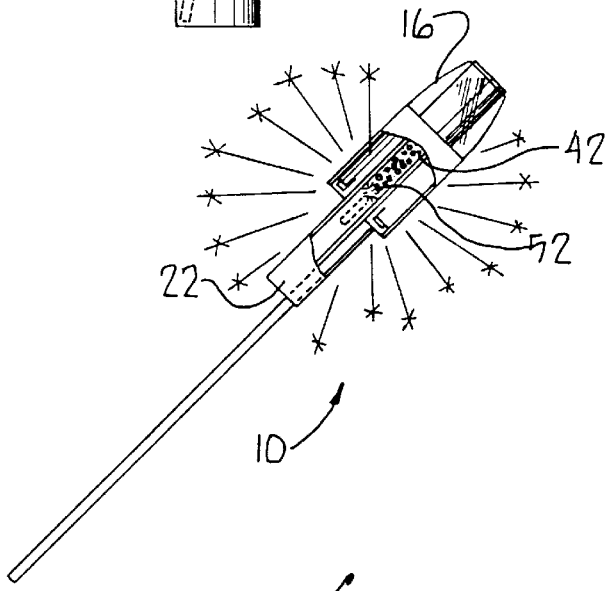
Fig. 6

SKYROCKET

BACKGROUND OF THE INVENTION

1. Field of the Invention

This invention is concerned with a skyrocket having multiple visual displays created by separate effects. More particularly, it is concerned with a skyrocket which provides a first visual display prior to launch generated by a first effect and which may continue after launching, and a second, separate visual effect which is displayed only after launching.

2. Description of the Prior Art

Skyrockets are ancient devices associated with celebrations, providing bright visual effects in the nighttime sky. Skyrockets as used herein are inexpensive fireworks, which typically include a guide stick, a fuse, with a rocket motor charge and an effect. Upon ignition of the motor, the skyrocket is propelled skywardly, with an internal timing fuse connecting the motor to the effect. When the effect ignites and explodes, flaming balls, commonly called "stars", are distributed either randomly or in a desired pattern to provide a visual display.

However entertaining, such skyrockets are limited to the lifting process and explosion of the effect. There has thus developed a need for an improved skyrocket having greater capacity to entertain without a significant increase in expense to manufacture.

SUMMARY OF THE INVENTION

This need has largely been met by the skyrocket of the present invention. That is to say, the skyrocket hereof is capable of not only the customary display created by explosion of the effect once airborne, but also of providing uniquely entertaining displays prior to ignition of the lifting charge which may continue as the skyrocket moves upwardly in flight. The skyrocket uses a translucent or transparent nose cone which displays the visual effect, while maintaining the aerodynamic shape of the skyrocket during flight.

In greater detail, the skyrocket of the present invention includes a body to which a guide stick is attached, as is conventional. A transparent or translucent nose cone is placed on the body. First and second layered effects are carried by the body, and a propulsive or lifting charge is also connected to the body. An ignition fuse extends from the top of the nose cone, and a second fuse extends downwardly to the motor. A third fuse, which is a timing fuse, may be used to interconnect the motor with the second effect whereby a the effect ignites and explodes only after the rocket has reached the desired height after lift-off. The first effect is preferably a strobe-type effect which burns brightly in a pulsating or intermittent manner prior to lift-off providing a strobing light display, while the second effect explodes after the rocket has lifted into the air.

As a result, the rocket remains relatively simple and inexpensive, but provides added entertainment value because of the ignition of the initial effect displayed through or emanating from the transparent or translucent nose cone. The provision of a fuse extending upwardly from the first effect and remote from the motor enhances safety by limiting exposure of the user to the skyrocket's motor and bursting charge.

BRIEF DESCRIPTION OF THE DRAWINGS

FIG. 3 is a view similar to FIG. 1 showing the skyrocket in condition for launch with the ignition fuse extending from the top of the skyrocket in a lit condition;

FIG. 4 is a view similar to FIG. 3, but with an upper part of the nose cone and body broken away for showing the first effect operational and viewable through the nose cone;

FIG. 5 is a view similar to FIG. 3, but with a portion of the casing for the motor broken away and showing the skyrocket lifting from the launch tube; and FIG. 6 is a view showing a part of the side wall of the body broken away to show the bursting charge and showing the stars exiting the skyrocket upon ignition of the second effect.

DESCRIPTION OF THE PREFERRED EMBODIMENT

Figure 1:
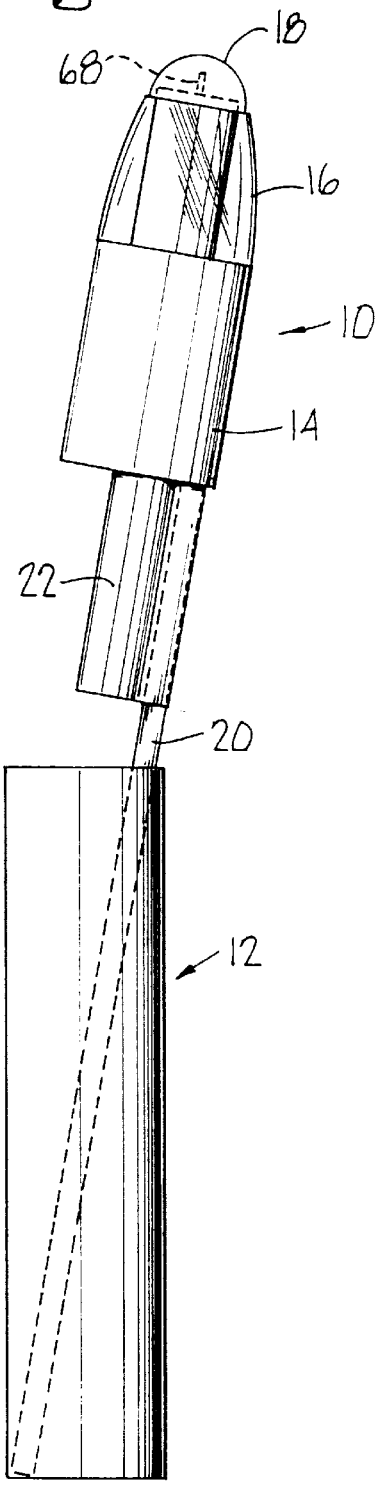
FIG. 1 is an elevational view of the skyrocket hereof in position for launch.

Referring now to the drawing, a skyrocket 10 in accordance with the present invention is shown mounted for launching from a tube-type launcher 12. Such skyrockets 10 are to be pointed toward the sky without any overhead obstructions as is obvious to the user, for purposes of enjoying the full effect of the skyrocket 10 as well as safety. As used herein, the terms "upper" and "lower" are used to indicate respectively the direction toward and away from which the skyrocket 10 is intended to travel. The skyrocket 10 broadly includes a body 14, a nose cone 16, cap 18 and guide stick 20. It may be appreciated that the skyrocket could be provided with guide means other than guide stick 20, such as stabilizing fins. A motor 22 may be positioned entirely within the body 14 or simply connected to the bottom end of the body 14 as is shown in the embodiment described herein.

In greater detail, the body 14 includes an outer cylindrical sidewall 24 defining a chamber 26 therein and receiving the nose cone 16 thereon. The sidewall 24 is typically of cardboard 28 and may be provided with a decorative paper cover 30. A bottom wall 32 is a disc with an outer circumferential flange 34 for mounting to the sidewall and an interior circular flange 36 for mounting the motor 22. The body 14 includes an inner tube 38 of paper or cardboard which extends preferably along the longitudinal axis of the body 14 and contains a first effect 40 mounted adjacent the normally upper end of the tube 38 and a second effect 42 contained within the tube 38 below first effect 40 and separated therefrom by barrier 44, typically of paper or cardboard. The tube 38 aids in isolating the first effect 40 and the second effect 42 from sources of ignition and moisture, while the barrier 44 helps to prevent premature ignition of the second effect 42 caused directly by ignition of the first effect 40. A covering tube 46 surrounds the tube 38 and, together with sidewall 24, provides an enclosed channel 48 for the passage of second or safety fuse 50 through the body 14 from adjacent the top of the first effect 40 to the motor 22. A third fuse is timing fuse 52 which is located within the tube 38 and connects the top of the motor 22 with the bottom of the second effect 42 to delay the firing of the second effect 42 until the skyrocket 10 has reached the desired height.

The first effect 40 may be provided as a strobe effect which, when lit, exhibits bright light in a pulsating level of intensity. Such strobe effects are well known to those skilled in the fireworks art and a suitable composition for such effects would be 18% ammonium perchlorate, 30% barium sulfate, 1% potassium bichromate, 50% aluminum-magnesium alloy and 1% rice starch. Alternatively, the first effect 40 may be constituted to, upon ignition, produce showers of sparks or the like in conjunction with the strobe effect, as shown in FIGS. 4 and 5. The second fuse 50 is of black powder coated paper or other fiber and indirectly connects the first effect 40 to the second effect 42 via the rocket motor 22 and the timing fuse 52. The second effect 42 may have many different compositions as is well known to those skilled in the art. Illustrated herewith is an effect 42 having a bursting charge 54 and a plurality of star charges 56 which, after ignition, present the appearance of colored streams or stars. A suitable bursting charge for a class C firework in accordance with the present invention would weigh about 3 grams and have a composition by weight of about 22% potassium perchlorate ($KClO_4$), 48% potassium nitrate ($KNO_3$), 26% carbon, typically charcoal (C), and 4% powder of polished gelatinous rice. The composition of the star charges 56 will vary according to color and are well known by those skilled in the art, but a typical effect might have star charges which display a red color after ignition and in total weigh about 10 grams. A typical composition by weight for a red star charge 56 would be 40% potassium perchlorate ($KClO_4$), 25% strontium carbonate ($SrCO_3$). 20% aluminum-magnesium powder alloy, 10% phenolic resin and 5% polyvinyl chloride.

The second effect 42 is operatively connected to the motor 22 by the timing fuse 52. The timing fuse delays the ignition of the bursting charge 54 to maximize the height of the skyrocket 10 after ignition of the motor 22. A typical timing fuse 52 for the skyrocket extends into both the second effect 42 and the motor and is made of fire-proof treated craft paper plus black powder providing a delay of 1 to 3 seconds.

The motor 22 includes a casing 58 of cardboard or paper and a stopper 60 having a central opening 62 for the passage of safety fuse 50 into contact with the lifting charge 64. The materials and quantity for the skyrocket may vary according to the size and desired lift for the rocket, but a suitable composition of the lifting charge 64 for a Class C firework would be about 4 grams and has a composition by weight of about 74% potassium benzoate ($KC_7H_5O_2$), 6% sulfur (S), and 20% carbon (C), preferably charcoal.

Figure 2:
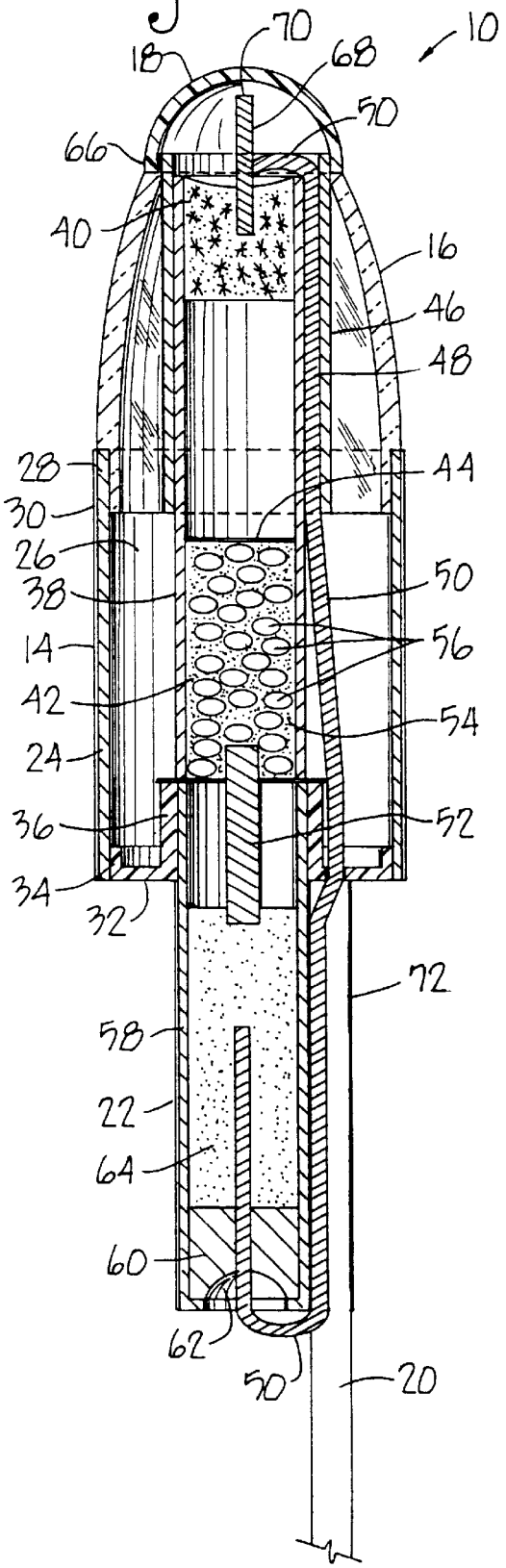
FIG. 2 is an enlarged vertical cross sectional view thereof, showing the first effect, the second effect, the fuses and the motor of the skyrocket.

The nose cone 16 is preferably made of a transparent or translucent synthetic resin such as polyvinyl chloride and adapted to fit atop the sidewall 24 of the body 14. The nose cone may be frustoconical or in the shape of a truncated ellipsoid as shown in the drawing, having a central opening 66. A cap 16 is removably mounted on the tube 38 and sits atop the nose cone 14 in covering relationship to the opening 66 through which the upper end of the tube 38 protrudes. An upwardly oriented ignition fuse 68 has a free end 70 for initial lighting by the user and is inserted into the first effect 40 and is operatively connected to safety fuse 50 as shown in FIG. 2. Thus, the cap 18 covers and protects the ignition fuse and the first effect 40 until the time of use. Wrapping 72 is glued to the motor 22 and guide stick 20 to couple the motor 22 and body 14 to the guide stick 20.

In use, the skyrocket 10 is placed into the launch tube 12 and the cap 18 removed. This exposes the free end 70 of the ignition fuse 68, which is lit by the user and burns downwardly as shown in FIG. 3. When the ignition fuse 68 ignites the first effect 40, the strobing light 74 may be viewed through the transparent or translucent nose cone 14 as the first effect burns away the tubes 38 and 46 and optionally sparks may emanate from opening 66. The display provided by the first effect 40 may continue not only up to launch but also as the skyrocket 10 lifts off in flight. As the first effect 40 provides a visual display, the safety fuse burns downwardly outside the tube 38 until it ignites the lifting charge. A delay of approximately 1 to 10, and more preferably 3 to 4 seconds may thus exist between the ignition of the first effect 40 and the ignition of the motor 22. As the motor 22 is ignited, the skyrocket 12 begins to lift free of the launch tube 12 as shown in FIG. 3, there thus being a visual display of ignited propellant from the bottom of the motor 22 as well as the strobe light 74 showing through the nose cone 16 and optionally spark effect emanating from the top of the tube 38 at the opposite, upper end of the skyrocket 12. As the lifting charge burns and is exhausted, the timing fuse 52 burns until igniting the bursting charge and scattering the stars from the second effect 42.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention, such as, for example providing various sizes of the rocket, and various colors for the effects and nose cones. In addition, the timing fuse 52 is optional, as the progressive burning of the lifting charge may provide a time delay between the initial ignition of the first effect 40 and the bursting of the second effect 42.

The inventor hereby states his intent to rely on the Doctrine of Equivalents to determine and assess the reasonably fair scope of his/their invention as pertains to any apparatus not materially departing from but outside the literal scope of the invention as set out in the following claims.

What is claimed is:

1. A skyrocket comprising:

a rocket motor;

a first fireworks effect;

a second fireworks effect;

an ignition fuse connected to said first fireworks effect; and a second fuse connecting said first fireworks effect to said motor, said fuse being of sufficient length whereby said first effect is ignited by said ignition fuse prior to ignition of the rocket motor; and a third fuse connecting said rocket motor to said second fireworks effect whereby ignition of said second effect is delayed until after ignition of said rocket motor.

2. A skyrocket as set forth in claim 1, wherein said second fireworks effect is a bursting effect.

3. A skyrocket as set forth in claim 1, wherein said first fireworks effect is a strobing effect.

4. A skyrocket as set forth in claim 1, including a body having an upper end and a lower end and coupled to said rocket motor, said first fireworks effect and said second fireworks effect, wherein said first fireworks effect is positioned normally above said second fireworks effect.

5. A skyrocket as set forth in claim 4, wherein said ignition fuse extends generally upwardly from the upper end of said body.

6. A skyrocket as set forth in claim 5, wherein said rocket motor is located adjacent the bottom end of said body and remotely from said ignition fuse.

7. A skyrocket as set forth in claim 6, including a translucent nose cone coupled to the upper end of said body whereby light generated upon ignition of said first fireworks effect is visible therethrough.

8. A skyrocket as set forth in claim 7, wherein said nose cone is transparent.

9. A skyrocket as set forth in claim 4, wherein said second fuse passes through said body from said first effect to said rocket motor.

10. A skyrocket as set forth in claim 9, wherein said body includes an outer tube and an inner tube defining a channel for the passage of said second fuse therethrough.

11. A skyrocket as set forth in claim 10, wherein said first effect and said second effect are positioned in said inner tube, and including a barrier between said first fireworks effect and said second fireworks effect to inhibit direct ignition of said second fireworks effect by said first fireworks effect.

12. A skyrocket comprising:

a body having an upper end and a lower end;

a rocket motor coupled to the lower end of said body;

a first fireworks effect carried by said body;

a second fireworks effect carried by said body;

an ignition fuse operatively connected to said first fireworks effect;

a second fuse operatively connecting said first fireworks effect to said rocket motor;

a third fuse operatively connecting said rocket motor to said second fireworks effect; and a translucent member connected to said body adjacent said first effect for enabling light generated by said first effect to be visible through said translucent member.

13. A skyrocket as set forth in claim 12, wherein said translucent member is a nose cone connected to the upper end of the body.

14. A skyrocket as set forth in claim 13, wherein said nose cone is transparent.

15. A skyrocket as set forth in claim 13, wherein said ignition fuse extends upwardly from the upper end of said body.

16. A skyrocket as set forth in claim 13, wherein said first fireworks effect is a strobe effect.

17. A skyrocket as set forth in claim 13, wherein said second fuse is positioned and configured to ignite said rocket motor after ignition of said first effect.

18. A skyrocket as set forth in claim 13, wherein said second fireworks effect is a bursting effect and is connected by said third fuse to said rocket motor to ignite after burnout of said rocket motor.

19. A skyrocket as set forth in claim 13, including a cap removably mounted to said nose cone to permit access to said ignition fuse.

20. A skyrocket as set forth in claim 13, wherein said body includes an inner tube receiving said first effect and said second effect therein, and an outer tube defining a channel for passage of said second fuse therethrough.

21. A method of providing a fireworks display comprising:

providing a skyrocket which includes an ignition fuse, a first fireworks effect, a second fireworks effect and a motor;

lighting the ignition fuse;

igniting the first fireworks effect prior to ignition of the motor;

igniting the motor prior to ignition of the second fireworks effect;

propelling the skyrocket by the motor; and igniting the second fireworks effect.

22. The method of claim 21, wherein the skyrocket includes a translucent nose cone, and including the step of generating strobing light from the first effect visible through the nose cone prior to propelling the skyrocket.

23. The method of claim 22, wherein the second fireworks effect includes a bursting charge, and including the step of igniting the bursting charge after the propulsion provided by the motor has been discontinued.

* * * * *